United States Patent [19]

Sherrick

[11] 4,416,203

[45] Nov. 22, 1983

[54] RAILWAY VEHICLE LAMINATED MOUNT SUSPENSION

[75] Inventor: James W. Sherrick, Edinboro, Pa.

[73] Assignee: Lord Corporation, Erie, Pa.

[21] Appl. No.: 388,286

[22] Filed: Jun. 14, 1982

Related U.S. Application Data

[63] Continuation of Ser. No. 195,969, Oct. 10, 1980, abandoned.

[51] Int. Cl.[3] ..... B61F 5/30; F16F 1/40; F16F 1/44

[52] U.S. Cl. ..... 105/224.1; 105/199 CB; 267/3; 267/63 A

[58] Field of Search ..... 105/224.1, 199 CB, 224; 267/3, 63 A, 63 R, 140, 140.1, 140.2, 140.3, 140.4, 140.5, 141, 141.1, 141.2, 141.3, 141.4, 141.5, 141.6, 141.7, 152, 153

[56] References Cited

U.S. PATENT DOCUMENTS

| | | | |
|---|---|---|---|
| 2,063,758 | 12/1936 | Schjolin | 105/224.1 X |
| 2,165,702 | 7/1939 | Haushalter | 267/63 A |
| 2,286,563 | 6/1942 | Mussey | 105/224.1 |
| 2,508,139 | 5/1950 | Binney | 267/3 X |
| 2,911,207 | 11/1959 | Coble, Jr. et al. | 267/153 |
| 3,086,765 | 4/1963 | Zanow | 267/63 R |
| 3,257,969 | 6/1966 | Thomas | 267/3 X |
| 3,504,902 | 4/1970 | Irwin | 267/152 |
| 3,638,582 | 2/1972 | Beebe | 105/224.1 X |
| 3,777,672 | 12/1973 | Schneider | 105/224.1 X |
| 3,839,969 | 10/1974 | Thum | 105/224.1 |
| 4,363,278 | 12/1982 | Mulcahy | 105/224.1 X |

*Primary Examiner*—Randolph Reese
*Assistant Examiner*—Howard Beltran

[57] ABSTRACT

A laminated mount for a railway vehicle suspension system is provided in which a body of elastomer is disposed between a top and bottom plate, and is divided into a plurality of individual layers by shims embedded at spaced intervals therewithin. Pins extend between the undercarriage of the vehicle and a bearing plate which is embedded between two layers of elastomer such that at least one layer of elastomer is disposed between the bearing plate and the bottom plate. The pins extend through selected layers of elastomer and effectively prevent them from deflecting in shear in response to lateral and/or longitudinal movements of the vehicle. This enables the mount herein to be designed with the combination of a relatively stiff shear spring rate to provide stability of the vehicle, and a soft compression spring rate to provide flexibility in response to vertical movements of the vehicle for wheel load equalization.

10 Claims, 3 Drawing Figures

RAILWAY VEHICLE LAMINATED MOUNT SUSPENSION

This is a continuation of application Ser. No. 195,969, filed Oct. 10, 1980 and now abandoned.

FIELD OF THE INVENTION

The subject invention relates to the area of mountings, and, more particularly, to a laminated mount in which the ratio of the compression to shear spring rates are controlled such that the mount is relatively soft in compression and stiff in shear.

BACKGROUND OF THE INVENTION

Laminated mounts consisting of a plurality of alternating layers of rubber and metal have been proposed for use in the primary suspension systems of railway vehicles as an alternative to leaf springs or coil springs. Properly designed, laminated mounts can be compact, dependable and provide controlled spring rates in several directions in a single mounting, in contrast to conventional coil and leaf springs. One of the primary design considerations for any mounting used in vehicle suspension systems is the provision of the proper ratio between the compression and shear spring rates. In many applications the compression spring rate must be such that adequate flexibility is provided in response to vertical motions for wheel load equalization in both the loaded and unloaded conditions of the vehicle. While the compression spring rate is necessarily relatively soft to achieve sufficient vertical flexibility, the shear spring rate must be stiff enough to provide stability to the vehicle in response to lateral (i.e., generally horizontal) movement.

Problems have been encountered in prior art laminated mounts with obtaining the appropriate compression to shear spring rate ratio. In those applications where space and load considerations require that vertical movements of the vehicle be accommodated by the mount in compression and lateral movements be accommodated in shear, it has been found that most prior art mounts provide a much higher shear springrate than desired to obtain the necessary compression springrate. The result is a mounting which is much stiffer and capable of less wheel load equalization that is required. One way of obtaining a softer compression spring rate has been to simply increase the number of elastomer layers in the laminated mount for greater total deflection under compression loads. However, this design results in a very soft shear springrate which is much lower than required. In addition, under compression loading such a mounting tends to be unstable which can further reduce the effective shear spring rate.

SUMMARY OF THE INVENTION

The laminated mount of the subject invention solves the problem of mounting instability encountered in prior art designs while providing the completion of a relatively soft springrate in compression and a stiff shear springrate. The mount includes a pair of continuous plates comprising its top and bottom surfaces which may be formed of a rigid material such as steel or a suitable equivalent. A body of elastomeric material is disposed between the top and bottom plates which is divided into a plurality of separate layers by shims embedded at spaced intervals therewithin. The elastomeric material is attached to the top and bottom plates and shims by vulcanization or any other suitable means.

At least two spaced apart upper mounting pins are disposed through the top plate and selected layers of elastomer, and terminate at a continuous bearing plate. The upper mounting pins extend upwardly from the top plate and engage holes formed in the undercarriage of a vehicle such as the truck of a railroad car. As discussed below, the bearing plate may be disposed at selected locations between the top and bottom plates but there must be at least one layer of elastomer between the bearing plate and the top and bottom plate to obtain desired performance of the mount. Lower mounting bolts are attached to the bottom plate flush with the upper surface thereof, and extend downwardly into engagement with the axle bearing block of the vehicle. The individual layers of the elastomer body are not adhered to the upper mounting pins, and are thus free to vertically deflect under compression relative to such pins.

As mentioned above, the upper and lower pins terminate at the bearing plate and bottom plate respectively. Accordingly, at least one layer of elastomer is provided through which neither the upper nor lower bolts extend. As discussed below, this configuration prevents those layers of elastomer through which the upper pins extend from being stressed in shear. Only the layer of layers of elastomer through which the upper pins do not extend may be stressed in shear as the vehicle components undergo relative lateral movements, since the upper pins are fixed to the vehicle undercarriage and the lower pins are fixed to the axle bearing block of the vehicle. In this manner, the shear spring rate of the mount can be easily and accurately controlled by limiting the number of elastomer layers which may be deflected in shear. A further advantage obtained from this construction is that the upper and lower mounting pins provide the mounting with lateral stability and a reduced tendency to buckle under load. The compression spring rate of the mount may thus be made relatively soft without sacrificing stability. In addition, as discussed below, the subject mount is provided with means to limit the overall compression deflection to provide further stability and to act as a safety feature.

Therefore, it is an object of the present invention to provide a laminated mount in which the compression spring rate may be made relatively soft and the shear spring rate relatively stiff without sacrificing the stability of the mount.

It is a further object of the subject invention to provide a laminated mount consisting of a plurality of layers of elastomer separated by shims formed of a rigid material through which at least two pairs of upper and lower mounting pins are selectively disposed to control the shear springrate of the mount.

It is another object of the subject invention to provide a laminated mount in which at least two pairs of upper and lower mounting pins extend through selected layers of elastomer to effectively limit the number of layers of elastomer which may be stressed in shear.

DESCRIPTION OF THE DRAWINGS

Objects in addition to the foregoing will become apparent upon consideration of the following description taken in conjunction with the accompanying drawings wherein.

DETAILED DESCRIPTION OF THE INVENTION

Figure 1:
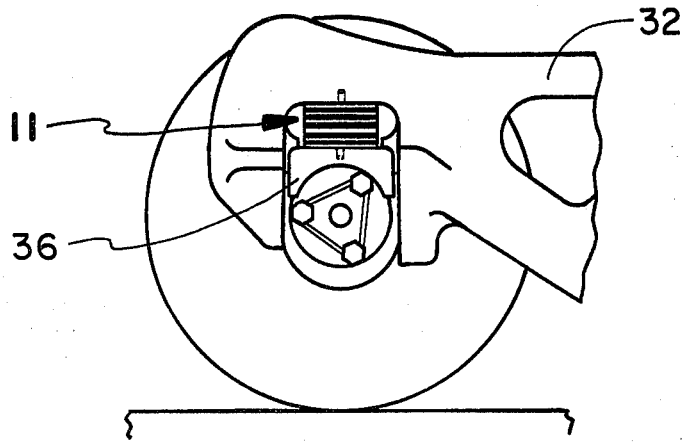
FIG. 1 is a partial front view of the laminated mount herein disposed between the undercarriage and axle of a railway vehicle.
Figure 2:
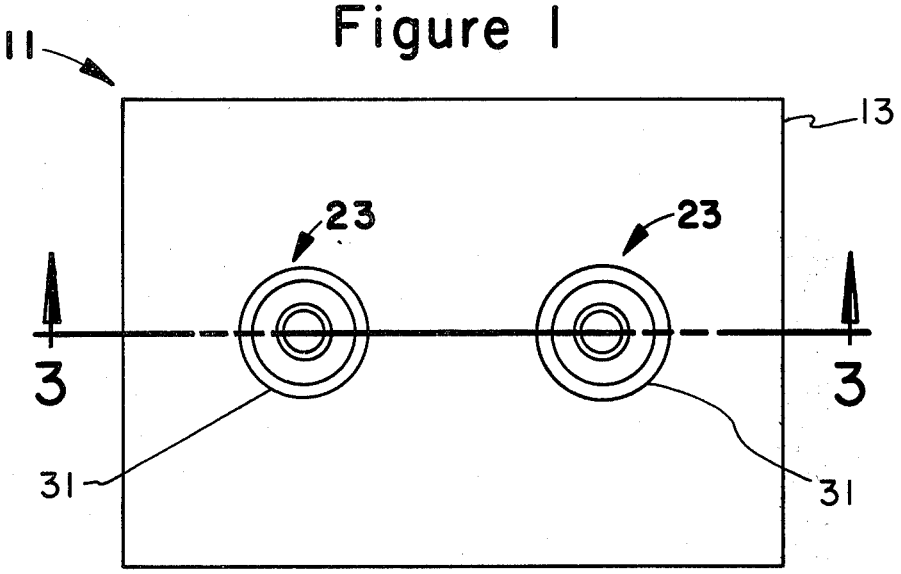
FIG. 2 is a plan view of the subject laminated mount.

Referring now to the drawings, the laminated mount of the subject invention is labelled generally with the reference 11. Mount 11 includes a top plate 13 and a bottom plate 15 both of which are formed in a continuous section of rigid material such as steel or a suitable equivalent. A body of elastomeric material is disposed between and attached to top and bottom plates 13 and 15, and is divided into a plurality of individual layers 17 by shims 19 embedded therewithin. The shims 19 are continuous plates of rigid material extending from one side of each of the elastomer layers 17 to the other, and are formed with a pair of spaced bores 20 for purposes to become apparent below. The elastomer layers 17 are bonded to the top and bottom plates 13 and 15 and to the shims 19 by vulcanization or any other suitable means. A continuous bearing plate 21 attaches to two elastomer layers 17 at a selected location between the top and bottom plates 13 and 15 to complete the sandwich-type configuration of mount 11.

Figure 3:
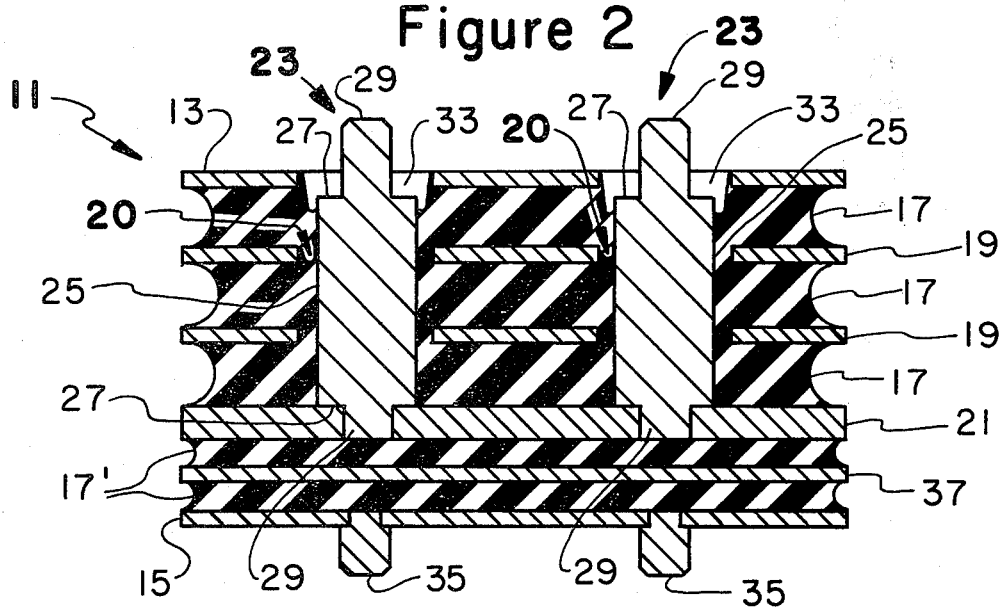
FIG. 3 is a partial cross-sectional view of the laminated mount of the subject invention taken generally along line 3—3 of FIG. 2.

A pair of upper mounting pins 23 extend from the top plate 13 through respective bores 20 of shims 19 to bearing plate 21. Each upper mounting pin 23 includes a central cylindrical-shaped portion 25 having bearing shoulders 27 at each end. An extension 29 of smaller diameter than the central portion 25 is formed at each end of the upper mounting pins 23. The extension 29 at the top end of upper mounting pins 23 fits through a bore 31 formed in top plate 13 and engages a hole formed in the undercarriage 32 of a rail vehicle. The extension 29 at the bottom end of upper mounting pins 23 is welded or otherwise attached flush with the bearing plate 21. As shown in FIG. 3, the shoulder 27 at the base of upper mounting pins 23 contacts the bearing plate 21, while a space 33 is provided between the shoulder 27 at the top of upper mounting pins 23 and top plate 13. It should also be noted that during the manufacture of mount 11, no adhesive coating or other securing means is placed on upper mounting pins 23. Thus the elastomer layers 17 merely abut upper mounting pins 23 and are free to slide upwardly and downwardly therealong in response to compressive forces applied to mount 11.

A pair of lower mounting pins 35 are attached by welding of other suitable means to the bottom plate 15 and extend flush with the upper surface thereof. Although the lower mounting pins 35 are shown in FIG. 3 to be in alignment with respective ones of the upper mounting pins 23, this is not critical and they may be offset to accommodate the space requirements of a particular application. Lower mounting pins 35 extend downwardly from bottom plate 15 for engagement with the axle bearing block 36 mounted to the axle 38 of the rail vehicle. In FIG. 3 the lower mounting pins 35 are shown as having the same diameter as the extensions 29 of upper mounting pins 23 but such dimensions are not critical and may be altered as desired.

As can be observed in FIG. 3, the upper mounting pins 23 extend through each of the elastomer layers 17 except the elastomer layer 17' disposed between and attaching to the bearing plate 21 and bottom plate 15. Thus, upon application of lateral forces which would place mount 11 in shear, the upper mounting pins 23 effectively "lock-out" or prevent any shear deflection of elastomer layers 17. The upper mounting pins 23, attaching at one end to the undercarriage 32 of the vehicle and at the other end to bearing plate 21, have the effect of nullifying any shear deflection of that portion of the mount 11 through which they extend. The elastomer layers 17 cannot deflect in shear since they are captively disposed between and attach to the top plate 13 and bearing plate 21 which move as a unit with upper mounting pins 23.

Only the elastomer layer 17' is free to deflect in shear in response to lateral and/or longitudinal lateral forces imposed on mount 11. Since neither the upper mounting pins 23 nor the lower mounting pins 35 extend through elastomer layer 17', relative lateral movement between the axle 38 of the vehicle (and, in turn, bottom plate 15) and the vehicle undercarriage (and, in turn, top plate 13, elastomer layers 17 and bearing plate 21 acting as a unit) causes elastomer layer 17' to deflect in shear. The mount 11 herein thus operates to control shear deflection and the overall shear springrate by permitting only a selected elastomer layer 17' to be deflected in shear in response to lateral loads.

It should be understood that the subject invention is not limited to the configuration shown in the Figures. If a softer shear springrate is desired, the bearing plate 21 may be moved upwardly within mount 11 to provide two or more individual elastomer layers 17' through which the upper mounting pins 23 do not extend thus permitting additional shear deflection. However, it is contemplated that the number of elastomer layers 17' which are permitted to deflect in shear should be limited to the extent that stability of the mount 11 is maintained. Upper mounting pins 23, extending between the undercarriage 32 of the vehicle and bearing plate 21, provide such stability and assure effective operation of mount 11 under vertical and lateral loads. Therefore, depending on the ratio of the compression to shear springrates desired in a particular application, the position of bearing plate 21 may be vertically adjusted to provide appropriate deflection in shear with the limitation that upper mounting pins 23 must extend through enough layers 17 of elastomer to maintain stability of the mount 11 in response to laterally applied loads.

As mentioned above, a space 33 is provided between the shoulder 27 formed at the top end of upper mounting pins 23 and the top plate 13. Although this is an optional feature of the subject invention, it may be important in some instances where the total amount of deflection of mount 11 under compression loading needs to be limited. In response to a force applied normal to mount 11, each of the elastomer layers 17 undergo essentially equal compression deflection. If the normal compression load reaches a predetermined level, the undercarriage 32 of the rail vehicle will engage the shoulder 27 of upper mounting pins 23. Since the shoulder 27 at the base of each of the upper mounting pins 23 engages bearing plate 21, further application of the normal force will be transferred directly to the elastomer layer 17' disposed between bearing plate 21 and the bottom plate 15. Any additional deflection of mount 11 will thus be governed by the compression springrate of the single elastomer layer 17'. By providing a continuous shim 37 within elastomer layer 17', which extends flush with its outer edges to prevent or at least severely restrain bulging, the compression springrate may be made extremely high and effectively prevent any further significant deflection. The total compression deflection of mount 11 may thus be essentially limited to the distance between upper surface of top plate 13 and the shoulder 27 of upper mounting pins 23.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mount for providing flexibility and wheel load equalization between the undercarriage and axles of a vehicle comprising:

a top plate and a bottom plate;

a body of elastomeric material disposed between and attaching to said top and bottom plates;

a plurality of shim means disposed at spaced intervals within said body of elastomeric material, said shim means dividing said body of elastomeric material into a plurality of individual layers;

a bearing plate disposed between and attaching to two of said elastomer layers such that at least one of said elastomer layers is disposed between said bearing plate and top and bottom plates;

at least two lower pin means attaching at a spaced interval to said bottom plate and extending downwardly therefrom;

at least two upper pin means, said upper pin means extending downwardly from said top plate through at least one of said elastomer layers and attaching to said bearing plate, whereby upon application of a normal force to said top plate of said mount each of said elastomer layers deflect in compression, and upon application of a lateral force to said mount only said at least one of said elastomer layers disposed between said bearing plate and said bottom plate deflects in shear, said elastomer layers disposed between said top plate and said bearing plate being prevented from deflecting in shear by said upper pin means extending therebetween.

2. The mount of claim 1 wherein a single layer of elastomer is disposed between said bearing plate and said bottom plate, said single layer of elastomer including an elongated shim embedded therewithin.

3. The mount of claim 1 wherein each of said upper pin means is formed with a bearing surface at each end, the bearing surface formed at the lower end of said upper pin means being attached to said bearing plate, and the bearing surface at the upper end of said upper pin means being disposed at a spaced interval from said top plate, whereby upon application of said normal face to said mount said top plate moves downwardly through said space between said bearing surface formed on the upper end of said upper pin means and said top plate as said elastomer layers deflect in compression, said undercarriage of said vehicle contacting said bearing surface formed on the upper end of said upper pin means upon further application of said normal force and transmitting said normal force through said upper pin means and said bearing plate directly to said at least one elastomer layer disposed between said bearing plate and said bottom plate for limiting further compression of said mount.

4. A mount for providing flexibility and wheel load equalization between the undercarriage and axles of a vehicle comprising:

a top plate and a bottom plate;

a body of elastomeric material disposed between and attaching to said top and bottom plate;

a plurality of shim means disposed at spaced intervals within said body of elastomeric material, said shim means dividing said body of elastomeric material into a plurality of individual layers;

a bearing plate disposed between and attaching to two of said elastomer layers such that one of said elastomer layers is disposed between said bearing plate and top and bottom plates;

at least two lower pin means attaching at a spaced interval to said bottom plate and extending downwardly therefrom;

at least two upper pin means each formed with a bearing surface at each end, said upper pin means extending downwardly from said top plate through a plurality of said elastomer layers to said bearing plate, the bearing surfaces formed at the lower end of said upper pin means engaging said bearing plate and the bearing surface formed at the upper end of said upper pin means being disposed at a spaced interval from said top plate, whereby upon application of a normal force to said mount said top plate moves downwardly as each of said elastomer layers deflect in compression, said undercarriage of said vehicle contacting the bearing surface formed on the upper end of said upper pin means upon further application of said normal force and transmitting said normal force through said upper pin means and said bearing plate directly to said single elastomer layer disposed between said bearing plate and said bottom plate for limiting further compression of said mount.

5. The mount of claim 4 wherein said elastomer layer disposed between said bearing plate and said bottom plate includes an elongated shim formed of a rigid material embedded therewithin.

6. A mount for providing flexibility and wheel load equalization between the undercarriage and axles of a vehicle comprising:

a top plate and a bottom plate;

a body of elastomeric material disposed between and attaching to said top and bottom plate;

a plurality of shim means disposed at spaced intervals within said body of elastomeric material, said shim means dividing said body of elastomer material into a plurality of individual layers;

a bearing plate disposed between and attaching to two of said elastomer layers such that one of said elastomer layers is disposed between said bearing plate and said bottom plate;

at least two lower pin means attaching at a spaced interval to said bottom plate and extending downwardly therefrom;

at least two upper pin means each formed with a bearing surface at each end, said upper pin means extending downwardly from said top plate through a plurality of said elastomer layers to said bearing plate, the bearing surface formed at the lower end of said upper pin means engaging said bearing plate and the bearing surface formed at the upper end of said upper pin means being disposed at a spaced interval from said top plate, whereby upon application of a normal force to said mount said undercarriage of said vehicle moves downwardly as each of said elastomer layers deflect in compression, said top plate contacting the bearing surface formed on the upper end of said upper pin means upon further application of said normal force and transmitting said normal force through said upper pin means and said bearing plate directly to said single elastomer layer disposed between said bearing plate and said bottom plate for limiting further compression of said mount, and upon application of a lateral force to said mount only said elastomer layer disposed between said bearing plate and said bottom plate deflects in shear, said elastomer layers disposed between said top plate and said bearing plate being prevented from deflecting in shear by said upper pin means extending therebetween.

7. The mount of claim 6 wherein said elastomer layer disposed between said bearing plate and said bottom plate includes an elongated shim formed of a rigid material embedded therewithin.

8. In a railway vehicle mount of the type including a body of elastomeric material having first and second opposite ends respectively attachable to first and second vertically spaced and relatively moveable vehicle components for compressive deflection of said body upon relative vertical movement of said vehicle components toward each other and for lateral shear deflection of said body upon relative horizontal movement between said vehicle components, the improvement comprising:

rigid means for increasing the lateral shear spring rate of said body in relation to the compression spring rate thereof;

said rigid means including (a) a bearing plate member extending through and bonded to said elastomer body in spaced and generally parallel relationship to said opposite ends thereof, and (b) pin means fixedly connected to and extending from said bearing plate member to one of said ends of said body for preventing lateral shear deflection of a first portion of said body between said plate and said one end of said body, and for restricting lateral shear deflection of said body to a second portion thereof between said bearing plate member and the other of said ends of said body; whereby upon relative vertical movement of said vehicle components towards each other both of said portions of said body deflect in compression, and upon relative horizontal movement between said vehicles components only said second portion of said body deflects in lateral shear.

9. A mount as in claim 8, and further including first and second opposite end plates respectively bonded to said first and second opposite ends of said body, said pin means extending to the one of said end plates bonded to said one of said body ends.

10. A mount as in claim 9, wherein said pin means includes at least two pin members each extending beyond said one of said end plates for engagement with said one of said vehicle components.

* * * * *